US006682164B2

(12) United States Patent
Vega et al.

(10) Patent No.: US 6,682,164 B2
(45) Date of Patent: Jan. 27, 2004

(54) METHOD AND APPARATUS FOR ADAPTIVE SERVICING OF INKJET PRINTERS

(75) Inventors: Ramon Vega, Barcelona (ES); Xavier Girones, Tarragona (ES); Xavier Bruch, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/917,889

(22) Filed: Jul. 31, 2001

(65) Prior Publication Data

US 2003/0030690 A1 Feb. 13, 2003

(51) Int. Cl.[7] ..... B41J 2/165
(52) U.S. Cl. ..... 347/22; 347/23; 347/29
(58) Field of Search ..... 347/22, 23, 29

(56) References Cited

U.S. PATENT DOCUMENTS 5,172,140 A * 12/1992 Hirabayshi et al. ..... 346/140
5,900,889 A * 5/1999 Tsukuda ..... 347/23
6,312,087 B1 * 11/2001 Imai et al. ..... 347/23
6,364,442 B1 * 4/2002 Kawase et al. ..... 347/5

* cited by examiner

*Primary Examiner*—Stephen D. Meier
*Assistant Examiner*—Lam Nguyen

(57) ABSTRACT

A method for correcting deviations from the normal performance of the service station by adapting the level of servicing a printhead receives based upon the age of the service station. For relatively newer service stations, the service stations may be caused to perform relatively less servicing operations on the printheads to thereby conserve ink and relatively increase the life of the service station and the printheads. For relatively older service stations, the service stations may be caused to perform relatively heavier servicing operations on the printheads to substantially compensate for the deleterious effects arising from the aging of the service station.

7 Claims, 4 Drawing Sheets

METHOD AND APPARATUS FOR ADAPTIVE SERVICING OF INKJET PRINTERS

FIELD OF THE INVENTION

This invention relates generally to inkjet printers. More specifically, the present invention pertains to adapting service operations performed on a printhead of an inkjet printer based upon the calculated age of a service station.

BACKGROUND OF THE INVENTION

In FIG. 1, there is schematically illustrated part of a known printer device (e.g., a large format printing device) having an array of printheads 100 in a parallel row. More specifically, FIG. 1 illustrates six printheads 102–112. Each of the printheads 102–112 includes a plurality of printer nozzles (not shown) for firing ink 114, 116 onto a print medium 120. Although FIG. 1 depicts the printer device as having six printheads 102–112, printer devices have been known to possess any number of printheads, e.g., two, four, or more.

The printheads 102–112 are typically constrained to move in a direction 170 with respect to the print medium 120, e.g., paper. In addition, the print medium 120 is also constrained to move in a further direction 160. During a normal print operation, the printheads 102–112 are moved into a first position with respect to the print medium 120 and a plurality of ink droplets 114, 116 are fired from the same plurality of printer nozzles contained within each of the printheads 102–112. After completion of a print operation, the printheads 102–112 are moved in a direction 170 toward a second position and another print operation is performed. In a like manner, the printheads 102–112 are repeatedly moved in a direction 170 across the print medium 120 and a print operation is performed after each such movement of the printheads 102–112. When the printheads 102–112 reach an edge of the print medium 120, the print medium is typically moved a short distance in a direction 160, parallel to a main length of the print medium 120, and another print operation is performed. The printheads 102–112 are then moved in a direction 170 back across the print medium 120 and yet another print operation is performed. In this manner, a complete printed page may be produced.

A more detailed description of the printer device illustrated in FIG. 1 may found in commonly assigned application Ser. No. 09/502,667 filed on Feb. 11, 2000, by Xavier Bruch et al., the disclosure of which is hereby incorporated by reference in its entirety.

In order to maintain the quality of the printed output of the printer device, it is generally known to maintain the nozzles in substantially proper operating condition. In this respect, a service station 140 is typically provided along a travel path of the printheads 102–112. The service station 140 is typically configured to maintain the health of the printheads 102–112 by performing servicing operations on the printheads, e.g., a means for wiping, collecting spit ink, capping the nozzles, etc. The service station 140 typically includes a plurality of service station units 142–152 for performing servicing operations on the each of the printheads 102–112. Generally speaking, a respective service station unit 142–152 is provided for each of the printheads 102–112. The service station units 142–152 are typically housed within a service station frame 154.

A servicing protocol is typically implemented to control the times and manner in which the printheads 102–112 are serviced. For example, in one respect, if it is detected that certain of the nozzles of the printheads 102–112 have not fired any ink drops for a certain period of time, the printheads are moved to a position over the service station 140 and caused to fire a normally set number of ink drops to thereby clean out the nozzles. In addition, a wiping mechanism positioned in the service station 140 may be caused to wipe excess ink off the nozzles to thereby increase the probability of their proper functionality. In another respect, the protocol may cause the printheads 102–112 to spit a set number of ink drops into the service station after each printing pass in an effort to substantially prevent ink from drying within the nozzles. The servicing protocol typically sets the number of times as well as the frequency of servicing operations based upon a set of normal values which are themselves typically set by the printhead or service station manufacturer. In addition, the normal values of the servicing protocol may vary according to the set printmodes.

The above-described servicing process is generally known as an open loop servicing technique. That is, the servicing protocol that determines when to service the printheads 102–112 as well as the degree of servicing to be applied, takes into consideration certain variables, e.g., time uncapped, drops fired during last printing pass, time in cap, etc. However, these types of servicing protocols typically apply a relatively heavy treatment to greater ensure proper printhead performance regardless of the age of the printheads 102–112. One problem associated with the open loop servicing technique is that ink may be wasted by virtue of spitting more ink drops than is necessary, oftentimes resulting in faster aging of the printheads as well as the service station.

Printer devices have also been known to include a drop detector module 130 operable to detect whether the nozzles of the printheads 102–112 are properly firing ink. In these types of printer devices, servicing operations on the printheads 102–112 may be triggered by detected errors, e.g., clogged nozzles, and a user's expectations, e.g., desired print quality. It is generally known to position the printheads 102–112 over the service station 140 and spit a certain number of ink drops to clean out the ink in the nozzles. This servicing process is generally known as a closed loop servicing technique. That is, servicing on the printheads 102–112 may occur based upon a closed loop servicing protocol under normal operating conditions, with extra, possibly lighter, servicing operations being performed based upon detected errors, e.g., clogged nozzles. In this regard, the closed loop servicing technique has certain advantages over the open loop servicing technique (e.g., does not waste a relatively large amount of ink, extends the life of the printheads and service station, etc.). However, printer devices that implement the closed loop servicing technique are relatively more expensive and complicated and thus may be unsuitable for certain types of printers (e.g., less expensive printer models).

The age of the service station 140 typically has an impact on the effectiveness of the servicing operation as well as its efficiency. That is, relatively new (or younger) service stations generally perform servicing operations relatively more effectively and efficiently than relatively older service stations. In this respect, older service stations are typically less capable of performing servicing operations in a substantially adequate manner than newer service stations, within the confines of an open loop servicing algorithm. The performance of service stations typically tend to deteriorate with time by virtue of a plurality of factors, e.g., aerosol, ink, wear, dust, etc. Known open loop servicing techniques are generally ill-equipped to compensate for the aging of the service stations. One result of failing to compensate for the aging of the service stations is that when the same level of servicing is performed by an aged service station, the level of servicing may be insufficient to maintain the printheads in relatively proper operating condition, or may otherwise result in wasted ink and unnecessary stress applied on the printheads.

SUMMARY OF THE INVENTION

According to one aspect, the present invention pertains to a method for adapting a service operation of a service station. In the method, a normal service operation is determined and an event related to the normal service operation is assigned. In addition, a number of occurrences of the event is tracked and the service operation is modified from the normal service operation in response to the tracked number of occurrences of the event.

According to another aspect, the present invention relates to an apparatus for adapting a service operation of a service station. The apparatus includes a controller configured to accept a normal service operation and assignment of an event related to the normal service operation. In addition, the apparatus includes a counter operable to track a number of occurrences of the event, in which the controller is operable to modify the service operation from the normal service operation in response to the tracked number of occurrences of the event.

According to yet another aspect, the present invention pertains to a computer readable storage medium on which is embedded one or more computer programs, where the one or more computer programs implement a method for adapting a service operation of a service station according to a calculated age of the service station. The one or more computer programs include a set of instructions for determining a normal service operation and assigning an event related to the normal service operation. The one or more computer programs further including a set of instructions for tracking an occurrence of the event and modifying the service operation from the normal service operation in response to the tracked number of occurrences of the event.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. However, one of ordinary skill in the art would readily recognize that the same principles are equally applicable to, and can be implemented in, any printer device that utilizes any number of printheads and service stations, and that any such variation would be within such modifications that do not depart from the true spirit and scope of the present invention.

According to the principles of the present invention, by characterizing the effects of aging on the service station, a servicing algorithm may be configured to adapt the servicing operation on a printhead of an inkjet printer according to the characterized effects of service station aging. In this respect, for relatively newer service stations, the algorithm may cause the service station to perform relatively less servicing operations on the printhead to thereby conserve ink and relatively increase the life of the service station and the printhead. Further, for relatively older service stations, the algorithm may cause the service station to perform relatively heavier servicing operations on the printhead to substantially compensate for the deleterious effects arising from the aging of the service station. In effect, therefore, the algorithm operates to optimize the performance of the service station by causing deviations from the normal service operations of the service stations. Thus, for example, at least by virtue of the smaller number of ink drops spitted during the earlier age of the printhead, the life of the printhead may be relatively extended, the volume of the spittoon in the service station may be kept at a relatively lower level for a longer period of time, the costs associated with performing printing operations may be decreased, etc.

Figure 2:
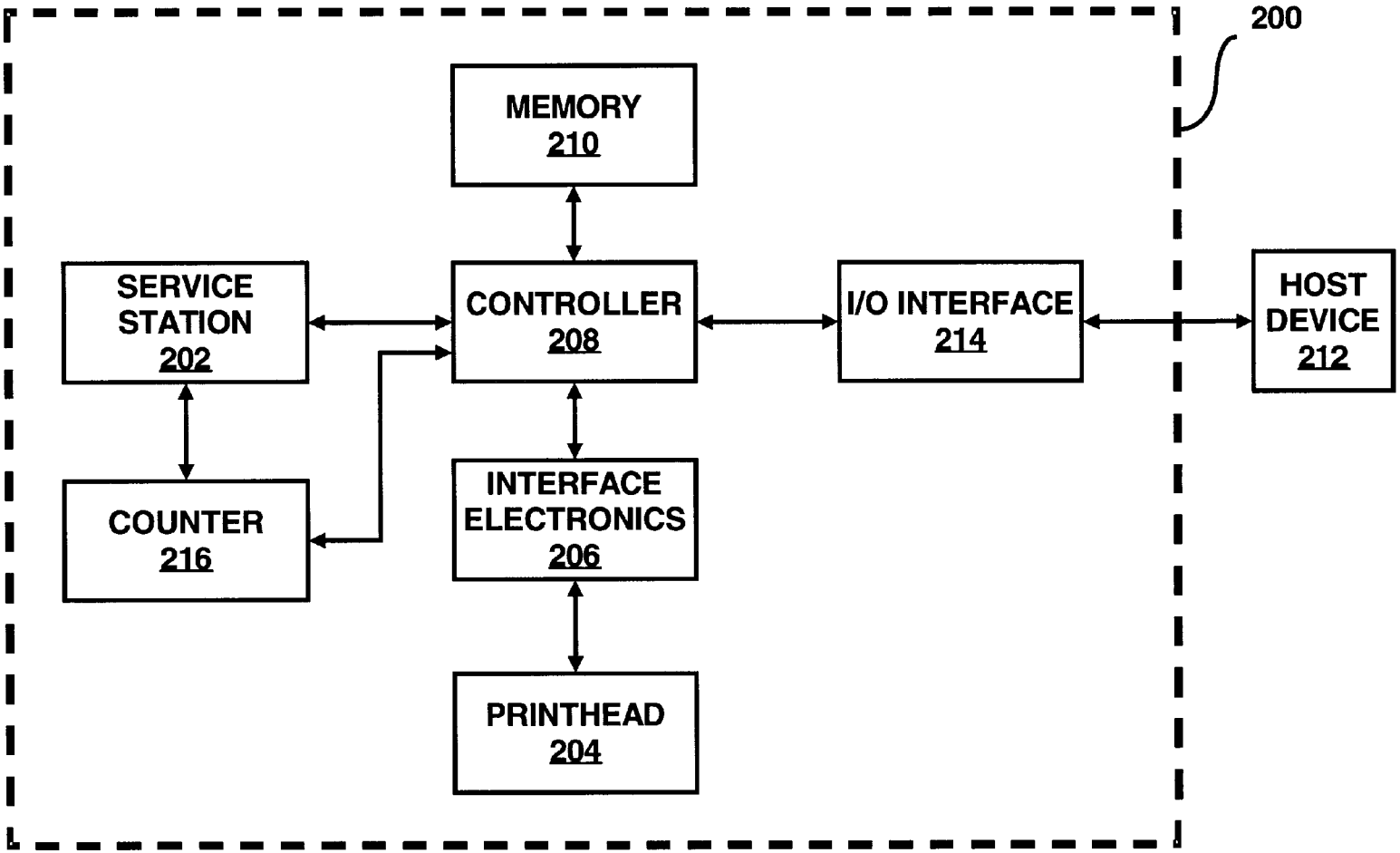
FIG. 2 illustrates an exemplary block diagram of a printer in accordance with the principles of the present invention.

Referring first to FIG. 2, there is illustrated an exemplary block diagram of a printer 200 in accordance with the principles of the present invention. As will become better understood from a reading of present disclosure, the following description of the block diagram describes one manner in which a printer 200 having a service station 202 may be operated in accordance with the principles of the present invention. In this respect, it is to be understood that the following description of the block diagram illustrated in FIG. 2 is but one manner of a variety of different manners in which such a printer 200 may be operated.

Figure 1:
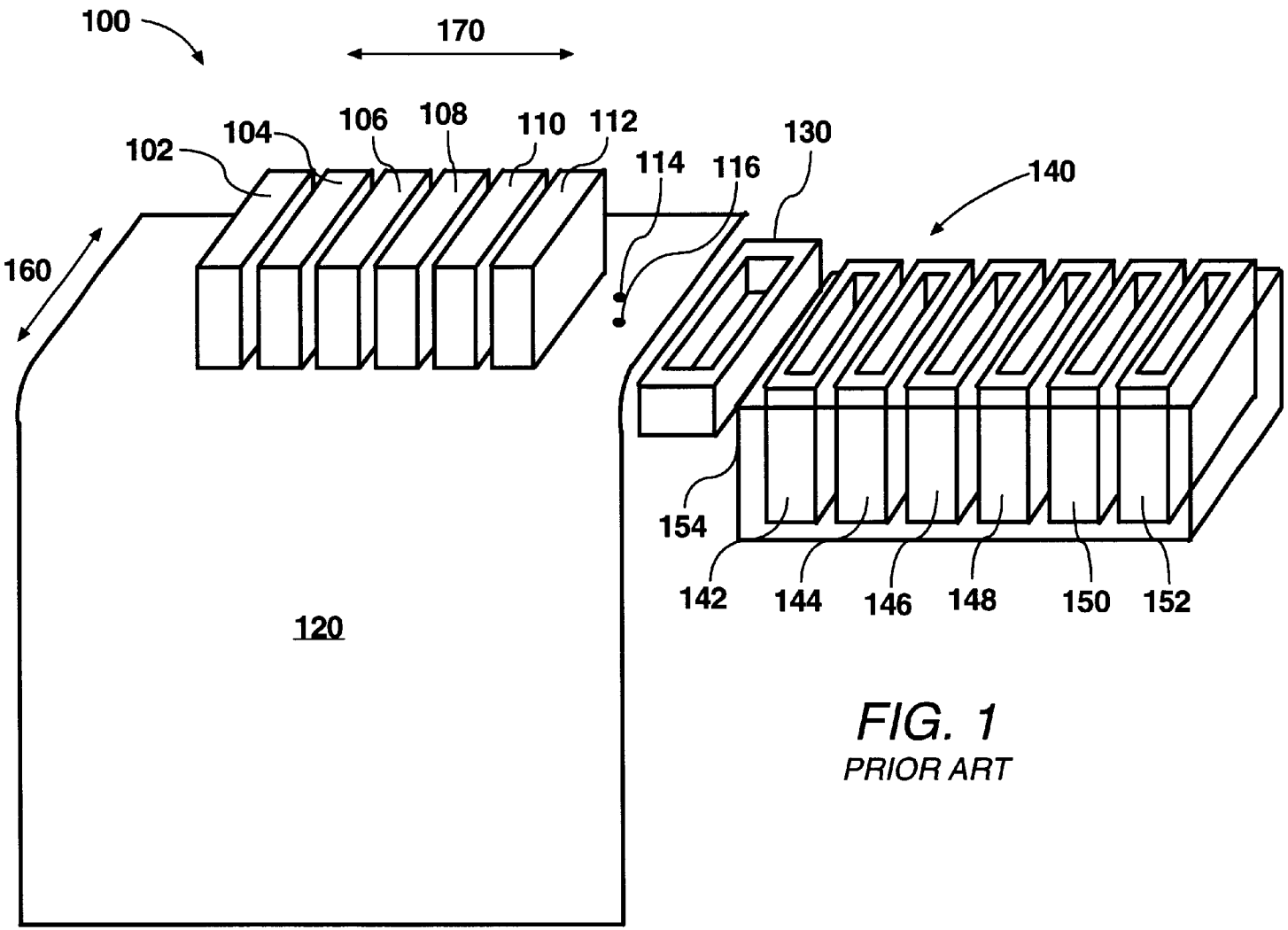
FIG. 1 PRIOR ART
FIG. 1 illustrates a schematic diagram of a conventional printer device showing a manner in which a set of print heads are manipulated with respect to other components of the printer device.

Generally speaking, although FIG. 2 illustrates a single printhead 204, it is to be understood that the printer 200 may include any reasonably suitable number of printheads without deviating from the scope and spirit of the present invention. The printhead 204 is configured to repeatedly pass across a medium in individual, horizontal swaths or passes during a printing operation to print a particular image (e.g., picture, text, diagrams, etc.) onto the medium, as described hereinabove with respect to FIG. 1.

The printer 200 also includes interface electronics 206 configured to provide an interface between a controller 208 and components (not shown) for moving the printhead 204, e.g., a carriage, belt and pulley system, etc. The interface electronics 206 may include, for example, circuits for moving the printhead 204, the medium, firing individual nozzles of the printhead, and the like.

The controller 208 may be configured to provide control logic for the printer 200, which provides the functionality for the printer. In this respect, the controller 208 may be implemented by a microprocessor, a micro-controller, an application specific integrated circuit, and the like. The controller 208 may be interfaced with a memory 210 configured to provide storage of a computer software that provides the functionality of the printer 200 and may be executed by the controller. The memory 210 may also be configured to provide a temporary storage area for data/file received by the printer 200 from a host device 212, such as a computer, server, workstation, and the like. The memory 210 may be implemented as a combination of volatile and non-volatile memory, such as dynamic random access memory ("RAM"), EEPROM, flash memory, and the like. It is within the purview of the present invention that the memory 210 may be included in the host device 212, without deviating from the scope and spirit of the present invention.

The controller 208 may be further interfaced with an I/O interface 214 configured to provide a communication channel between a host device 212 and the printer 200. The I/O interface 214 may conform to protocols such as RS-232, parallel, small computer system interface, universal serial bus, etc. In addition, the controller 208 may be interfaced with the service station 202. Although not illustrated in FIG. 2, interface electronics may be provided between the controller 208 and the service station 202 in a fashion similar to that described hereinabove with respect to the interface electronics 206 provided between the controller and the printhead 204.

A counter 216 may be interfaced with the service station 202. The counter 216 may be configured to track the occurrences of certain events within the service station 202 with respect to some servicing operation. That is, the counter 216 may be configured to track the number of times any servicing operation is performed on the printhead 204. More specifically, the counter 216 may be configured to track, for example, the number of spits the printhead 204 performs into the spittoon of the service station 202, the number of wipe cycles, the number of cap/uncap cycles, the number of solvent applications, the number of print operations performed, the total print time, the uncapped time, or the like. In addition, the counter 216 may be configured to track the performance of more than one servicing operation concurrently. The counter 216 may be implemented by a number of integrated circuit counters, a suitable machine, ASIC or other similar devices.

The counter 216 may be interfaced with the controller 208. In this respect, the controller 208 may be configured to control various aspects of the counter, e.g., which event to track, re-setting the counter when a new service station is installed on the printer, etc. In addition, the controller 208 may be configured to control the servicing operations performed by the service station 202 on the printhead 204 in response to the number event occurrences. Thus, for relatively young service stations (i.e., service stations which have performed a relatively small number of tracked events), the number of servicing operations, e.g., spits, wipes, caps, or the like, may be relatively fewer than normally performed. Furthermore, for relatively old service stations (i.e., service stations which have performed a relatively large number of servicing operations), a relatively greater number of servicing operations may be performed than normally practiced.

In addition, although not illustrated in FIG. 2, a counter may be included in the controller 208. The counter of the controller 208 may be configured to track those events enumerated above with respect to the counter 216. In this respect, in a manner similar to that described hereinabove with respect to the counter 216, the controller 208 may be configured to adapt the servicing operations performed on the printhead 204 according to the age (i.e., the number of times an event occurs) of the service station 202.

Figure 3:
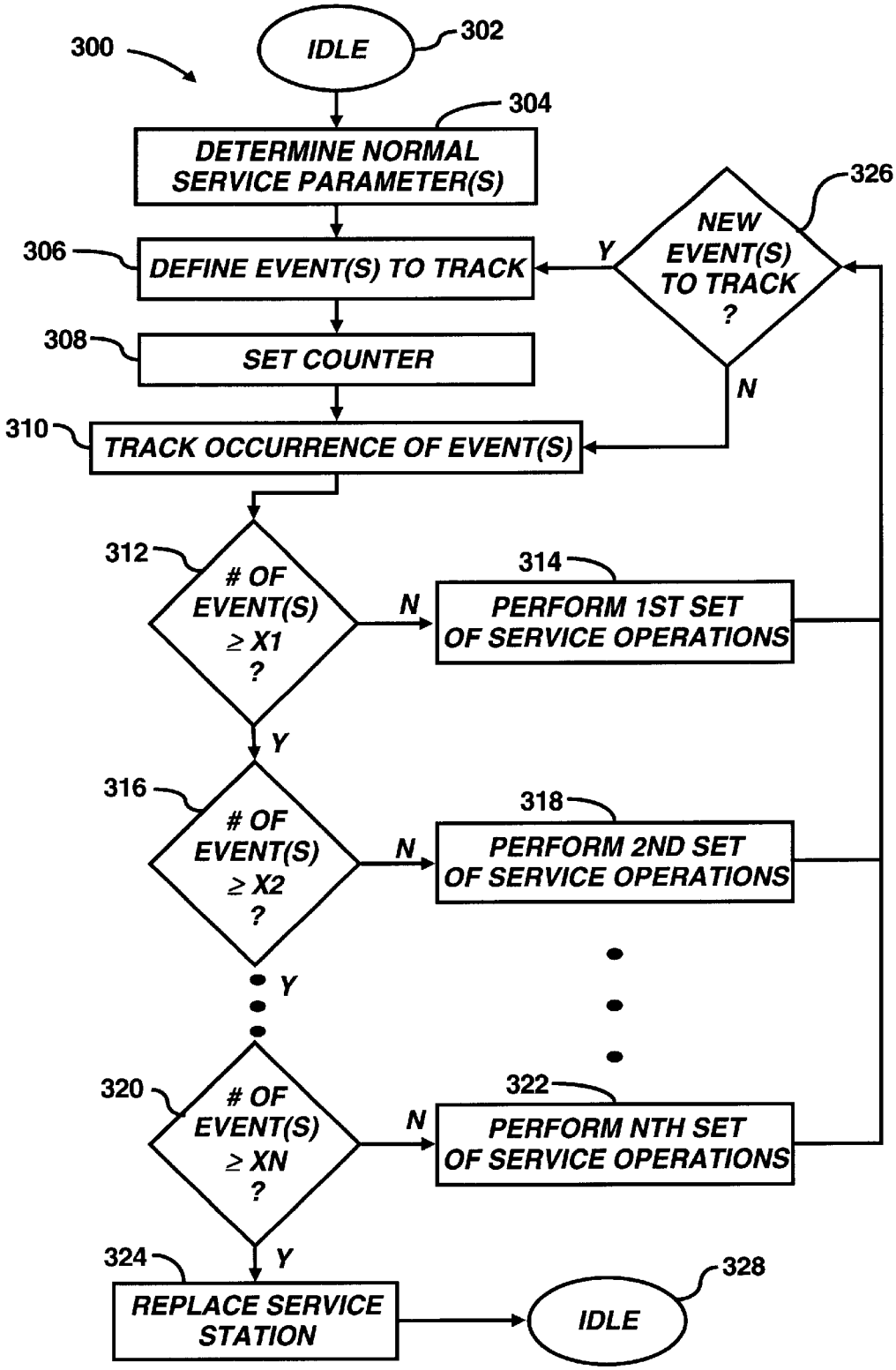
FIG. 3 illustrates an exemplary flow diagram of a manner in which the principles of the present invention may be practiced.

Referring to FIG. 3, there is illustrated an exemplary flow diagram 300 of a manner in which the principles of the present invention may be practiced. The following description of the flow diagram 300 is made with reference to the block diagram illustrated in FIG. 2, and thus makes reference to the elements illustrated therein. It is to be understood that the steps illustrated in the flow diagram 300 may be contained as a subroutine in any desired computer accessible medium. Such medium including the memory 210, internal and external computer memory units, and other types of computer accessible media, such as a compact disc readable by a storage device. Thus, although particular reference is made in the following description of FIG. 2 to the controller 208 as performing certain functions, it is to be understood that those functions may be performed by any electronic device capable of executing the above-described function.

In step 302, if the service station is brand new or has been capped for a certain period of time, the printhead 204 may be configured to spit a normally set number of ink drops. In addition, the service station 202 may also be configured to perform servicing operations, in addition to those normally practiced, prior to beginning printing operations. For example, the controller 208 may signal the printhead 204 to perform 100 spits and the service station 202 to perform one wipe cycle. The number of spits and manner of servicing operations may be based upon a set of normal service parameters. In addition to those operations described hereinabove, the printer 200 may receive a plot file from a host device 212 at step 302.

At step 304, the normal service parameters may be determined by the controller 208 or the controller may receive the normal service parameters through input from the service station or from a user. The normal service parameters generally refer to the number, frequency, and manner of servicing events the service station 202 is to perform on the printhead 204 during a routine printing operation. The normal service parameters may typically depend upon instructions supplied by the printhead manufacturer and/or the service station manufacturer for a selected printmode, or it may be calculated through testing. As described hereinabove, the normal service parameters are typically set to account for worst case situations and do not account for aging of the service station. Accordingly, normal service parameters typically are relatively excessive when the service station is relatively new and relatively insufficient when the service station is relatively old.

Additionally, at step 304, only those normal service parameters relating to the events to be tracked in 306 may be determined by the controller 208. At step 306, the controller 208 is configured (e.g., programmed) to track at least one servicing event, e.g., the number of spits the printhead 204 performs into a spittoon of the service station 202, the number of wipe cycles, the number of cap cycles, or the like. If the service station 202 has not been previously used, the counter 216 may be set to zero for the tracked servicing event at step 308. However, if the service station 202 has been previously utilized, then the counter 216 may be continuously operated.

At step 310, the selected servicing event(s) is tracked to determine the occurrences of the event(s) to thereby determine the estimated age of the service station 202. The data created by tracking the servicing event(s) may be forwarded to the controller 208 or it may be stored in the memory 210 for reference by the controller. The controller 208 may implement the received data in calculating the age of the service station 202. At least by virtue of the calculated age, the controller 208 may configure the level and type of servicing operation to be performed on the printhead 204. In determining when to perform the servicing operations on the printhead 204, the controller 208 may operate in an open loop manner (e.g., servicing the printhead between a set number of printing passes). The controller 208 may operate to either increase or decrease the level of servicing performed during each scheduled servicing operation based upon the estimated age of the service station 202.

At step 312, the controller 208 determines whether the data received from the counter 216 indicates that the tracked event(s) occurrences is greater than or equal to a first predetermined value (X1). If the tracked number of events is less than the first predetermined value (X1), the controller 208 transmits a signal to the service station 202 to perform a first set of servicing operations at step 314.

If, in step 312, the tracked event(s) occurrences is greater than or equal to the first predetermined value (X1), the controller 208 determines whether the tracked event(s) occurrences is greater than or equal to a second predetermined value (X2) at step 316. If the tracked event(s) occurrences is less than the second predetermined value (X2), the controller 208 transmits a signal to the service station 202 to perform a second set of servicing operations at step 318.

If, in step 316, the tracked event(s) occurrences is greater than or equal to the second predetermined value (X2), the controller 208 determines whether the tracked event(s) occurrences is greater than or equal to a next predetermined value. If the tracked event(s) occurrences is less than the next predetermined value, the controller 208 transmits a signal to the service station 202 to perform a next set of servicing operations. The above-described process proceeds for an N number of times as indicated at steps 320 and 322. The value of N in steps 320 and 322 may be determined from tests designed to optimize the service station 202 and printhead performances, and thus may vary according to the various types of service stations and printheads implemented in a printer.

The first predetermined value X1 is relatively lower than the second predetermined value. Moreover, the second predetermined value is relatively lower than the next predetermined value and so forth. The predetermined values (X1, X2 . . . XN) may be based upon a plurality of factors. According to a preferred embodiment, the predetermined values (X1, X2 . . . XN) may be calculated from tests designed to optimize the service station 202 and printhead 204 performances, which may vary according to the type of service station and printhead implemented in a printer. In this respect, the predetermined values (X1, X2 . . . XN) may vary according to the various types of service stations and printheads implemented in a printer.

The first set of servicing operations is relatively lower than the second set of servicing operations. Moreover, the second set of servicing operations is relatively lower than the next set and so forth. Additionally, the sets of servicing operations may also be determined from tests designed to optimize the service station 202 and printhead performances, which may vary according to the type of service station and printhead implemented in a printer. In this respect, the sets of servicing operations may vary according to the various types of service stations and printheads implemented in the printers. The sets of servicing operations may each include a predetermined number of spits, wipes, cap cycles, and the like. Thus, for example, the first set of servicing operations may include a fewer number of spits than the second set of servicing operations.

Once the predetermined values (X1, X2 . . . XN) and the sets of servicing operations have been determined, a chart may be created to provide the controller 208 with a basis upon which the type of servicing operation is to be performed. Table 1 illustrates an exemplary chart that the controller 208 may implement in operating the servicing operations on a printhead 204 based upon the calculated age of the printhead. Although Table 1 lists specific numbers of spitting and wiping operations for the printhead, it is to be understood that those numbers are for illustrative purposes only and are not meant to be limiting in any respect.

In Table 1, the level of servicing under normal conditions may equate to the term "A". If the calculated age of the service station 202 is less than or equal to X1, the servicing operations may be set at A1 level, which may equate to a lesser degree of servicing operations than those under normal operating conditions A. In this instance, each of the printheads K, C, M, Y, each representing a different color, may perform the listed number of spitting operations. In addition, if the calculated age of the service station 202 is less than or equal to X2 and greater than X1, the servicing operations may be set at A2 level, which may also equate to a lesser degree of servicing operations than those under normal operating conditions. However, as seen in Table 1, the number of spitting operations for the printheads K, C, M, Y, at the A2 level are greater than those enumerated for the A1 level. The progressive nature of servicing operation levels is illustrated in Table 1.

TABLE 1

| Service Station Life | Level of Servicing | K | C | M | Y | Action | K | C | M | Y |
|---|---|---|---|---|---|---|---|---|---|---|
| X1 | A1 | 50 | 50 | 50 | 50 | — | — | — | — | — |
| X2 | A2 | 75 | 75 | 75 | 75 | — | — | — | — | — |
| X3 | A3 | 200 | 200 | 200 | 200 | — | — | — | — | — |
| X4 | A4 | 100 | 100 | 100 | 100 | Wipe | 500 | 500 | 500 | 500 |
| X5 | A5 | 150 | 150 | 150 | 150 | Wipe | 800 | 800 | 800 | 800 |
| XN | AN | 200 | 200 | 200 | 200 | Wipe | 1000 | 1000 | 1000 | 1000 |

In addition to or in place of the use of Table 1, the predetermined values (X1, X2 . . . XN) may be implemented to derive an age factor (AF) equation to determine a factor applicable to the servicing operations. Depending upon the tracked event(s) occurrences, the age factor (AF) may be applied to the normal servicing operation to derive each set of servicing operation to thereby adapt the level of servicing applied on the printhead 204. Thus, the age factor (AF) may vary for each set of servicing operations.

For example, if the normal servicing parameter requires the printhead 204 to spit 100 drops of ink during a servicing operation, and the tracked event occurrences falls below the first predetermined value (X1), an age factor (AF) that decreases the number of spits may be applied. In this case, for example, the age factor (AF) may equal approximately 0.9. Application of the age factor (AF=0.9) to the normal servicing parameter (100 spits) yields 90 spits. Thus, the number of spits is reduced by application of the age factor (AF). If the tracked number of servicing events falls above the first predetermined value (X1) and below the second predetermined value (X2), an age factor (AF) that increases the number of spits may be applied. In this case, for example, the age factor (AF) may equal approximately 1.1. Application of the age factor (AF=1.1) to the normal servicing parameter (100 spits) yields 110 spits. Thus, a varied age factor (AF) may be selected for each set of servicing operations to thereby compensate for the age of the service station.

Following the performance of a set of servicing operations, steps 314, 318 . . . , at step 326, the controller 208 may determine whether the occurrences of a new event(s) is to be tracked. If a new event(s) is to be tracked, step 306 may be repeated to define another event(s) to track. Otherwise, the number of occurrences of the previously defined event(s) may be tracked at step 310.

If, in step 320, the tracked event(s) occurrences is greater than or equal to the Nth predetermined value (XN), the controller 208 may indicate that the service station requires replacement. In this instance, the service station 208 may be replaced at step 324. At step 328, the controller 208 may control the printer to enter into an idle state, e.g., stand-by mode, shut down, etc.

Figure 4A:
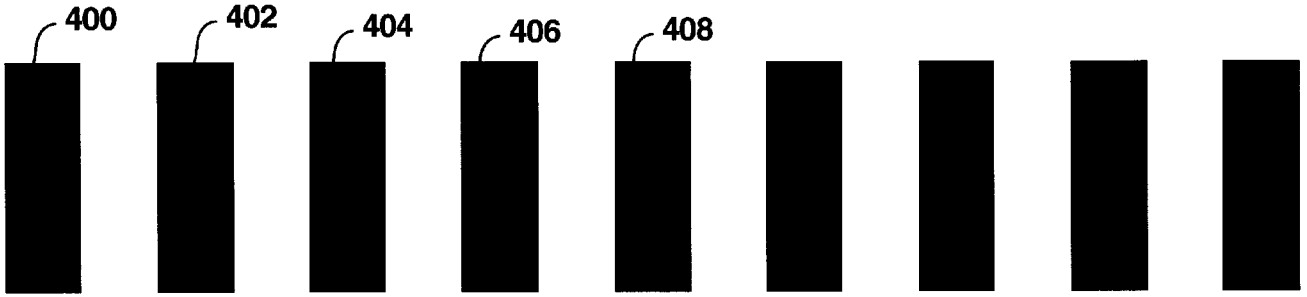
FIGS. 4A and 4B illustrate an exemplary manner in which a diagnostic plot may be performed in accordance with the principles of the present invention.
Figure 4B:
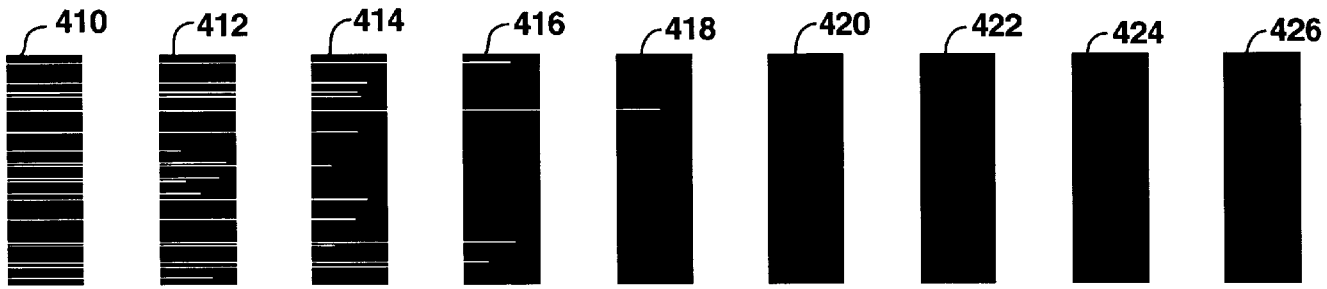

In addition, FIGS. 4A and 4B illustrate an exemplary manner in which a diagnostic plot may be performed in accordance with the principles of the present invention. FIG. 4A illustrates a diagnostic plot of a printhead having a complete set of properly functioning nozzles. In this respect, each of the printed plots 400–408 are completely filled with ink. In contrast, FIG. 4B illustrates a diagnostic plot of a printhead in which certain nozzles thereof are functioning improperly. The printed plot 410 includes a plurality of spaces indicating that certain of the nozzles are not properly firing ink. Between plots 410 and 412, a servicing operation may be performed on the printhead yielding printed plot 412. The servicing operation may be "fine tuned" to enable a greater level of servicing to be performed on those nozzles that may be misfiring. In one respect, for example, certain areas of the wiping mechanism may be improperly wiping the certain ones of the nozzles, thus resulting in certain of the nozzles misfiring. In this instance, the wiping mechanism may be replaced to overcome this deficiency.

In comparing printed plot 410 and 412, it may be seen that in printed plot 412, the number of misfiring nozzles has been reduced. After printing plot 412, another modified servicing operation may be performed and another plot 414 may be printed. Plot 414 has relatively fewer misfiring nozzles than plot 412. The above-described process of modifying the servicing operation may be sequentially repeated prior to printing plots 416–426. As seen at plot 426, all of the nozzles have been cleared and are functioning properly. Based on the foregoing, for example, the number and degree of servicing operations performed on the printhead may be modified to enable all of the nozzles to properly operate.

The level and frequency of the servicing operations performed on the printhead may be adapted from normal servicing operations based upon the calculated age of the service station. Accordingly, the effectiveness and efficiency of the servicing operations performed on the printhead by the service station may be optimized.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for adapting a service operation of a service station, said method comprising:

determining at least one normal service parameter;

assigning at least one event related to said at least one normal service parameter;

tracking a number of occurrences of said at least one event;

modifying a level of servicing performed during said service operation in response to said tracked number of occurrences of said at least one event;

performing a first set of servicing operations in response to said tracked number of occurrences of said at least one event being less than or equal to a first predetermined value, wherein said first set of servicing operations comprises:

printing a diagnostic plot by attempting to print onto a medium with each nozzle of a printhead; and performing a servicing operation on said printhead in response to at least one of said nozzles misfiring;

performing a second set of servicing operations in response to said tracked number of occurrences of said at least one event being less than or equal to a second predetermined value, wherein said second predetermined value is greater than said first predetermined value, wherein said second set of servicing operations comprises:

printing another diagnostic plot by attempting to print onto said medium with each nozzle of said printhead;

modifying said servicing operation in response to at least one of said nozzles misfiring; and performing said modified servicing operation on said printhead; and replacing said service station in response to said tracked number of occurrences of said at least one event being greater than a third predetermined value.

2. A method for adapting a service operation of a service station, said method comprising:

determining at least one normal service parameter, assigning at least one event related to said at least one normal service parameter;

tracking a number of occurrences of said at least one event;

modifying a level of servicing performed during said service operation in response to said tracked number of occurrences of said at least one event;

wherein said modifying step comprises applying a level of modification to said service operation in response to a predetermined modification level; and wherein said applying step comprises:

employing a table having a plurality of predetermined service operations depending upon said tracked number of occurrences of said at least one event;

printing a diagnostic plot by attempting to print onto a medium with each nozzle of a printhead;

performing a servicing operation on said printhead in response to at least one of said nozzles misfiring;

printing another diagnostic plot by attempting to print onto said medium wit each nozzle of said printhead;

modifying said servicing operation in response to at least one of said nozzles misfiring; and performing said modified servicing operation on said printhead.

3. A method for adapting a service operation of a service station, said method comprising:

determining at least one normal service parameter;

assigning at least one event related to said at least one normal service parameter;

tracking a number of occurrences of said at least one event;

modifying a level of servicing performed during said service operation in response to said tracked number of occurrences of said at least one event;

wherein said modifying step comprises applying a level of modification to said service operation in response to a predetermined modification level; and wherein said applying step comprises:

employing an age factor to said normal service parameter based upon the tracked number of occurrences of said at least one event, wherein said age factor varies according to the tracked number of occurrences of said at least one event;

printing a diagnostic plot by attempting to print onto a medium with each nozzle of a printhead;

performing a servicing operation on said printhead in response to at least one of said nozzles misfiring;

printing another diagnostic plot by attempting to print onto said medium with each nozzle of said printhead;

modifying said servicing operation in response to at least one of said nozzles misfiring; and performing said modified servicing operation on said printhead.

4. A method for adapting a service operation of a service station, said method comprising:

determining at least one normal service parameter;

assigning at least one event related to said at least one normal service parameter;

tracking a number of occurrences of said at least one event;

modifying a level of servicing performed during said service operation in response to said tracked number of occurrences of said at least one event;

wherein said at least one event tracking step comprises tracking a number of printhead spits into said service station;

printing a diagnostic plot by attempting to print onto a medium with each nozzle of a printhead;

performing a servicing operation on said printhead in response to at least one of said nozzles misfiring;

printing another diagnostic plot by attempting to print onto said medium with each nozzle of said printhead;

modifying said servicing operation in response to at least one of said nozzles misfiring; and performing said modified servicing operation on said printhead.

5. A method for adapting a service operation of a service station, said method comprising:

determining at least one normal service parameter;

assigning at least one event related to said at least one normal service parameter;

tracking a number of occurrences of said at least one event;

modifying a level of servicing performed during said service operation in response to said tracked number of occurrences of said at least one event;

printing a diagnostic plot by attempting to print onto a medium with each nozzle of a printhead;

performing a servicing operation on said printhead in response to at least one of said nozzles misfiring;

printing another diagnostic plot by attempting to print onto said medium with each nozzle of said printhead;

modifying said servicing operation in response to at least one of said nozzles misfiring; and performing said modified servicing operation on said printhead.

6. An apparatus for adapting a service operation of a service station, comprising:

a controller configured to:

determine at least one normal service parameter;

assign at least one event related to said at least one normal service parameter;

track a number of occurrences of said at least one event;

modify a level of servicing performed during said service operation in response to said tracked number of occurrences of said at least one event;

print a diagnostic plot by attempting to print onto a medium with each nozzle of a printhead;

perform a servicing operation on said printhead in response to at least one of said nozzles misfiring;

print another diagnostic plot by attempting to print onto said medium with each nozzle of said printhead;

modify said servicing operation in response to at least one of said nozzles misfiring; and perform said modified servicing operation on said printhead;

a counter operable to track a number of occurrences of said at least one event;

wherein said controller is operable to modify the level of servicing performed during said service operation in response to said tracked number of occurrences of said at least one event;

wherein said controller is operable to apply a level of modification to said service operation in response to a predetermined modification level; and wherein said controller is operable to employ an age factor to the normal service operation based upon the tracked number of occurrences of said at least one event, wherein said age factor varies according to the tracked number of occurrences of said at least one event.

7. A computer readable storage medium on which is embedded one or more computer programs, said one or more computer programs implementing a method for adapting a service operation of a service station according to a calculated age of said service station, said one or more computer programs comprising a set of instructions for:

determining at least one normal service parameter;

assigning at least one event related to said at least one normal service parameter;

tracking an occurrence of said at least one event;

modifying the level of servicing performed during said service operation in response to said tracked number of occurrences of said at least one event;

printing a diagnostic plot by attempting to print onto a medium with each nozzle of a printhead;

performing a servicing operation on said printhead in response to at least one of said nozzles misfiring;

printing another diagnostic plot by attempting to print onto said medium with each nozzle of said printhead;

modifying said servicing operation in response to at least one of said nozzles misfiring; and performing said modified servicing operation on said printhead.

* * * * *